US010327603B2

(12) United States Patent
Young et al.

(10) Patent No.: US 10,327,603 B2
(45) Date of Patent: Jun. 25, 2019

(54) NAPKIN DISPENSER

(75) Inventors: Michael Young, Mukwonago, WI (US); Nicholas Stanford Blair, Whitefish Bay, WI (US); Jeffrey Alan Wierschke, Sheboygan Falls, WI (US); Martin John Behling, II, Allenton, WI (US)

(73) Assignee: San Jamar, Inc., Elkhorn, WI (US)

( * ) Notice: Subject to any disclaimer, the term of this patent is extended or adjusted under 35 U.S.C. 154(b) by 1015 days.

(21) Appl. No.: 14/351,665

(22) PCT Filed: Oct. 13, 2011

(86) PCT No.: PCT/US2011/056062

§ 371 (c)(1),
(2), (4) Date: Jun. 3, 2014

(87) PCT Pub. No.: WO2013/055340

PCT Pub. Date: Apr. 18, 2013

(65) Prior Publication Data

US 2014/0326745 A1 Nov. 6, 2014

(51) Int. Cl.
*A47K 10/42* (2006.01)
*A47K 10/32* (2006.01)

(52) U.S. Cl.
CPC .... *A47K 10/422* (2013.01); *A47K 2010/3246* (2013.01)

(58) Field of Classification Search
CPC ..... A47K 10/422; A47K 2010/3233; A47K 2010/3246
See application file for complete search history.

(56) References Cited

U.S. PATENT DOCUMENTS 1,901,243 A * 3/1933 Horwitt ..... A47K 10/427 221/279
3,291,339 A * 12/1966 Hein ..... B65H 1/04 221/45
4,094,442 A 6/1978 Radek
4,706,844 A 11/1987 Omdoll et al.
(Continued)

FOREIGN PATENT DOCUMENTS

WO 2013030041 3/2013

OTHER PUBLICATIONS

EP 11873927.5, Extended European Search Report dated Aug. 28, 2015, 10 pages.
(Continued)

*Primary Examiner* — Gene O Crawford
*Assistant Examiner* — Kelvin L Randall, Jr.
(74) *Attorney, Agent, or Firm* — Boyle Fredrickson S.C.

(57) ABSTRACT

A product dispenser, such as for dispensing napkins, designed to be recessed in a countertop or wall, includes an elongated housing or chute for holding product, a faceplate assembly, and a collar for mounting the dispenser to the countertop or wall. The collar includes a locking arrangement for securing the collar in place without requiring any tools. The locking arrangement includes a thumb screw having a threaded shaft with a first end and a second end, a wing nut at the first end, and a flap at the second end. As the wing nut is rotated in a first direction, the flap is drawn upward until it engages a stop surface, such as the underside of the countertop or inside surface of a wall.

9 Claims, 9 Drawing Sheets

(56) References Cited

U.S. PATENT DOCUMENTS

| | | | | |
|---|---|---|---|---|
| 4,927,053 | A * | 5/1990 | Mayfield, III | B65G 1/07 221/279 |
| 5,135,136 | A * | 8/1992 | Moone | A47F 1/085 221/241 |
| 5,597,133 | A * | 1/1997 | Teague | A47K 10/38 221/102 |
| 5,649,676 | A * | 7/1997 | Lord | A47K 10/3827 242/595 |
| 5,954,226 | A * | 9/1999 | Peterson | A47F 1/06 221/59 |
| 9,198,546 | B1 * | 12/2015 | Brown | A47K 10/426 |
| 2005/0040177 | A1 | 2/2005 | Tramontina et al. | |
| 2005/0051663 | A1 * | 3/2005 | Walters | A47K 10/38 242/597.8 |
| 2006/0102641 | A1 * | 5/2006 | Cittadino | A47K 10/422 221/45 |
| 2008/0190952 | A1 * | 8/2008 | Strub | B65D 5/721 221/2 |
| 2013/0048664 | A1 * | 2/2013 | Siebel | A47K 10/422 221/63 |
| 2013/0048666 | A1 * | 2/2013 | Siebel | A47K 10/422 221/283 |

OTHER PUBLICATIONS

International Search Report and the Written Opinion of the International Searching Authority, or the Declaration; dated May 24, 2012—(9) Pages.

* cited by examiner 20
3
32
34
30
26
58
28
118
126
92
166
118
122
110
112
108
126
116
122
3
22
42
46

NAPKIN DISPENSER

BACKGROUND OF THE INVENTION

This invention relates generally to an apparatus for use in dispensing napkins or similar products. In particular, the invention relates to an apparatus for dispensing napkins from a recessed container.

Dispensers for napkins are often provided at quick service food locations, such as fast food restaurants and convenience stores. These dispensers are frequently positioned on a condiment serving bar or maintained on a stand. These dispensers allow food service patrons easy access to napkins.

While providing easy access to the napkins, conventional placement of such napkin dispensers is on a countertop. Countertop space, however, can be limited as other food-related items, such as condiments and cutlery, can also be stored on the countertop. Moreover, it is quite common for an ice and beverage dispenser and cup and lid dispensers to be positioned on the countertop. As a result, many restaurants and other establishments are increasingly using in-counter napkin dispensers that fit into the counter itself leaving only a small portion of the container—usually the faceplate—extending above and onto the counter. Such in-counter napkin dispensers generally consist of an elongated housing, a faceplate, a movable pressure plate, and a biasing spring. The faceplate and the housing collectively define an elongated storage chamber for receiving and storing a stack of napkins to be dispensed. The pressure plate is biased toward the faceplate by the biasing spring applying upward pressure on the stack of napkins to push the topmost napkin against the faceplate, which is preferably substantially flush mounted to the countertop.

To install the in-counter napkin dispenser, an opening must be cut or otherwise formed in the countertop. The elongated housing is then dropped into the opening until a flange at the upper end of the housing sits against the outer surface of the countertop. After loading the housing with the stack of napkins, a bracket is attached to the flange and the faceplate is then attached to the bracket. In some instances, fasteners are used to secure the housing flange to the countertop to fix the elongated housing in place.

One of the drawbacks of conventional in-counter napkin dispensers is that the size of the opening needed in the countertop is typically tailored to the particular dispenser to be used. As a result, it can be necessary to replace the entire countertop when changing dispensers. Another drawback is that in addition to cutting a hole in the countertop, fasteners, e.g., screws, are required to secure the elongated housing in place. This requires an installer to drill holes through the countertop, which can be time-consuming and permanently mars the countertop beyond the hole cut for the dispenser. Moreover, to remove the elongated housing, such as for cleaning, requires the fasteners to be removed, which can also be a time-consuming endeavor.

SUMMARY OF THE INVENTION

The present invention provides an apparatus for dispensing napkins or similar materials that can be mounted in a recessed position, either in-counter or, in another example, in a wall or cabinet. The apparatus is constructed to be workable with a number of different counter opening sizes and thus can often be used as a replacement napkin dispenser. Moreover, the apparatus can be installed without the use of tools and fasteners, and thus is believed to install more easily than conventional recessed napkin dispensers. The apparatus is also usable with countertops of varying thicknesses.

In this regard, it is believed the present invention provides an improved high-capacity napkin dispenser with multiple features that provide for enhanced operation compared to conventional napkin dispensers. For example, a napkin dispenser according to one embodiment of the invention, includes a collar that fits against the top surface of the countertop to allow the napkin dispenser to be used with counter openings that otherwise are too large for the napkin dispenser or to permit varying size dispensers to fit tightly into a wide variety of countertop openings. Moreover, the collar includes a set of hand-tightening screws, e.g., thumb screws, that when tightened draw the dispenser housing upward against the underside of the countertop. The dispenser housing may include lateral flaps that extend outwardly and engage the underside of the countertop as the hand-tightening screws are tightened down.

Therefore, in accordance with one aspect of the invention an apparatus for holding a product includes a mounting collar having a peripheral flange and an opening defined by the peripheral flange. The opening is configured to receive a container, and the mounting collar includes an upper surface for engaging the container and a lower surface for engaging a top of a mounting surface. The apparatus further has a locking arrangement supported by the mounting collar and operative to secure the mounting collar to the mounting surface without tools.

In accordance with another aspect of the invention, a dispensing system for use in a recessed position is provided. The system includes a collar adapted to fit in an opening formed in a wall or counter and a set of retainers for releasably securing the collar to the wall or counter. Each retainer includes a clamping member operative to clamp the collar to the wall or counter. The system further has a product dispenser having an elongated housing adapted to fit within the collar opening and a faceplate assembly releasably attached to the elongated housing and having an aperture that facilitates removal of product from the elongated housing.

According to another aspect of the invention, a napkin dispenser is comprised of an elongated housing adapted to hold a stack of napkins and a faceplate pivotally connected to the elongated assembly. The faceplate has an aperture for withdrawing an outermost napkin from the stack of napkins, and is pivotal between an open position and a closed position. A collar fits within an opening of a supporting surface, and is adapted to receive the elongated housing and support the elongated housing in a recessed position behind the supporting surface. The dispenser also has a set of clamps that releasably secure the collar to the supporting surface.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION

Figure 1:
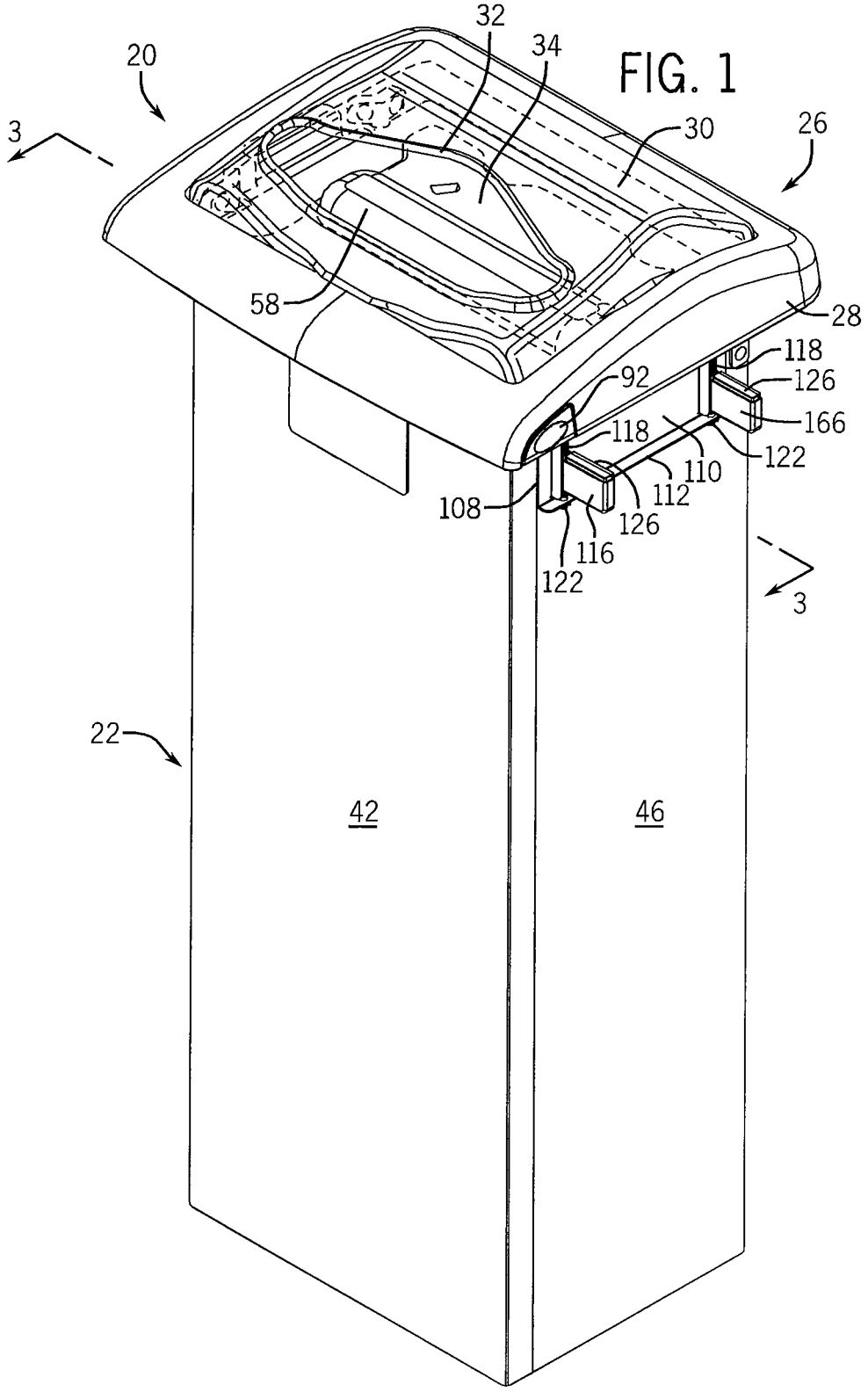
FIG. 1 is an isometric view of a napkin dispenser according the invention shown in an in-counter position.
Figure 2:
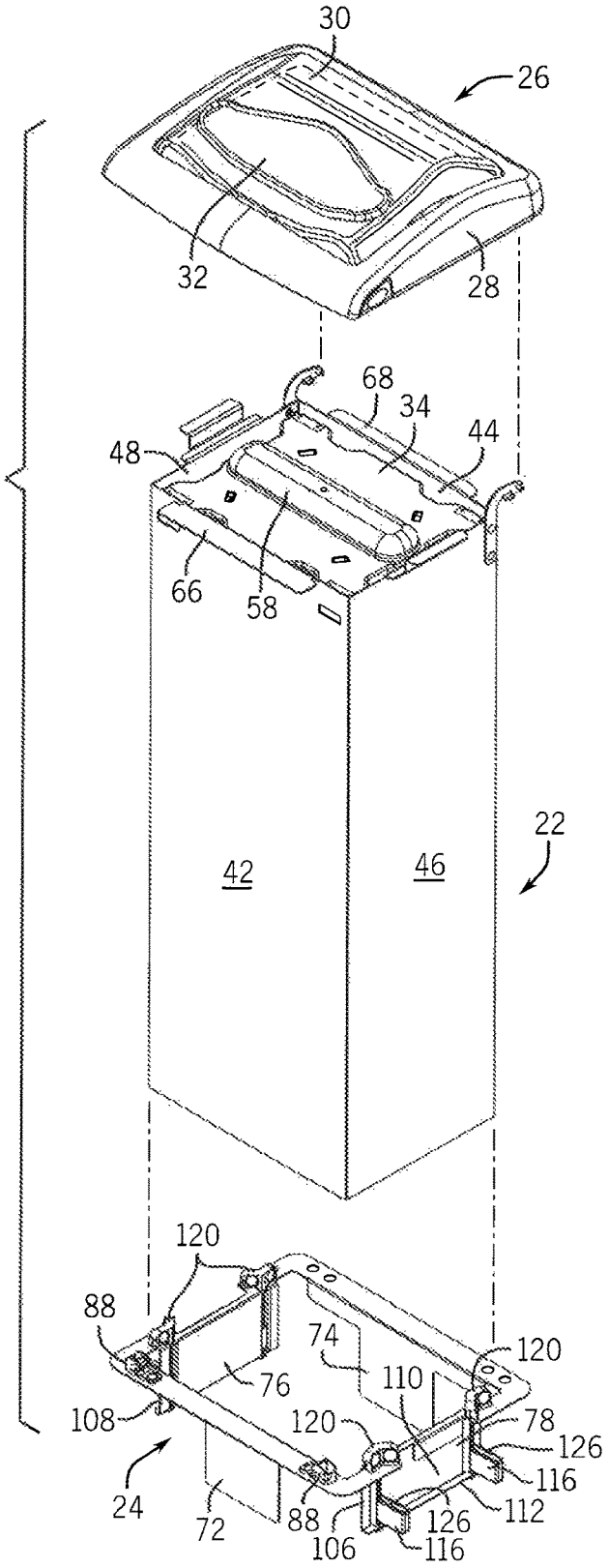
FIG. 2 is an exploded view of the napkin dispenser of FIG. 1.
Figure 3:
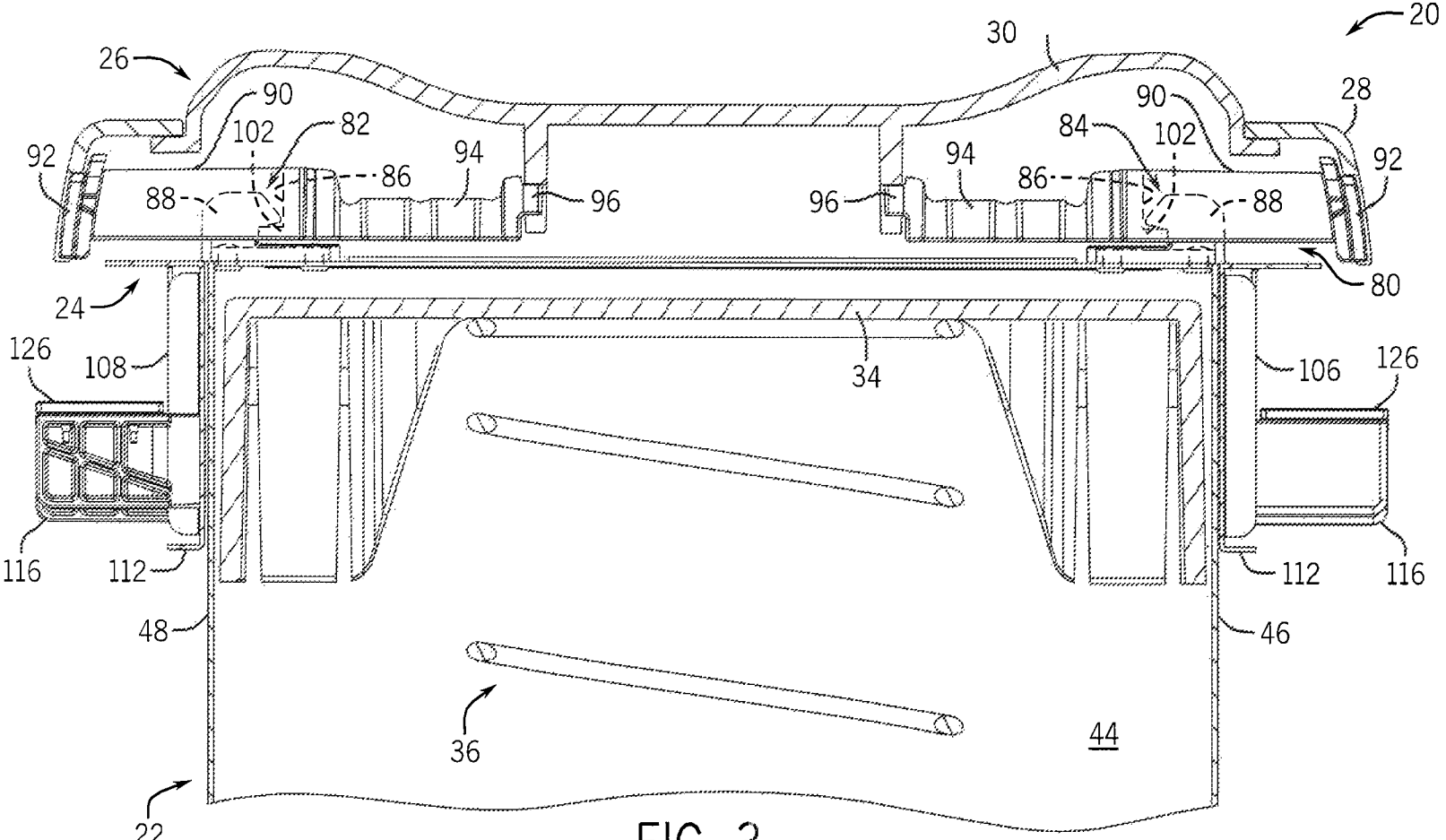
FIG. 3 is a section view of the napkin dispenser of FIG. 1 taken along line 3-3 of FIG. 1.
Figure 6:
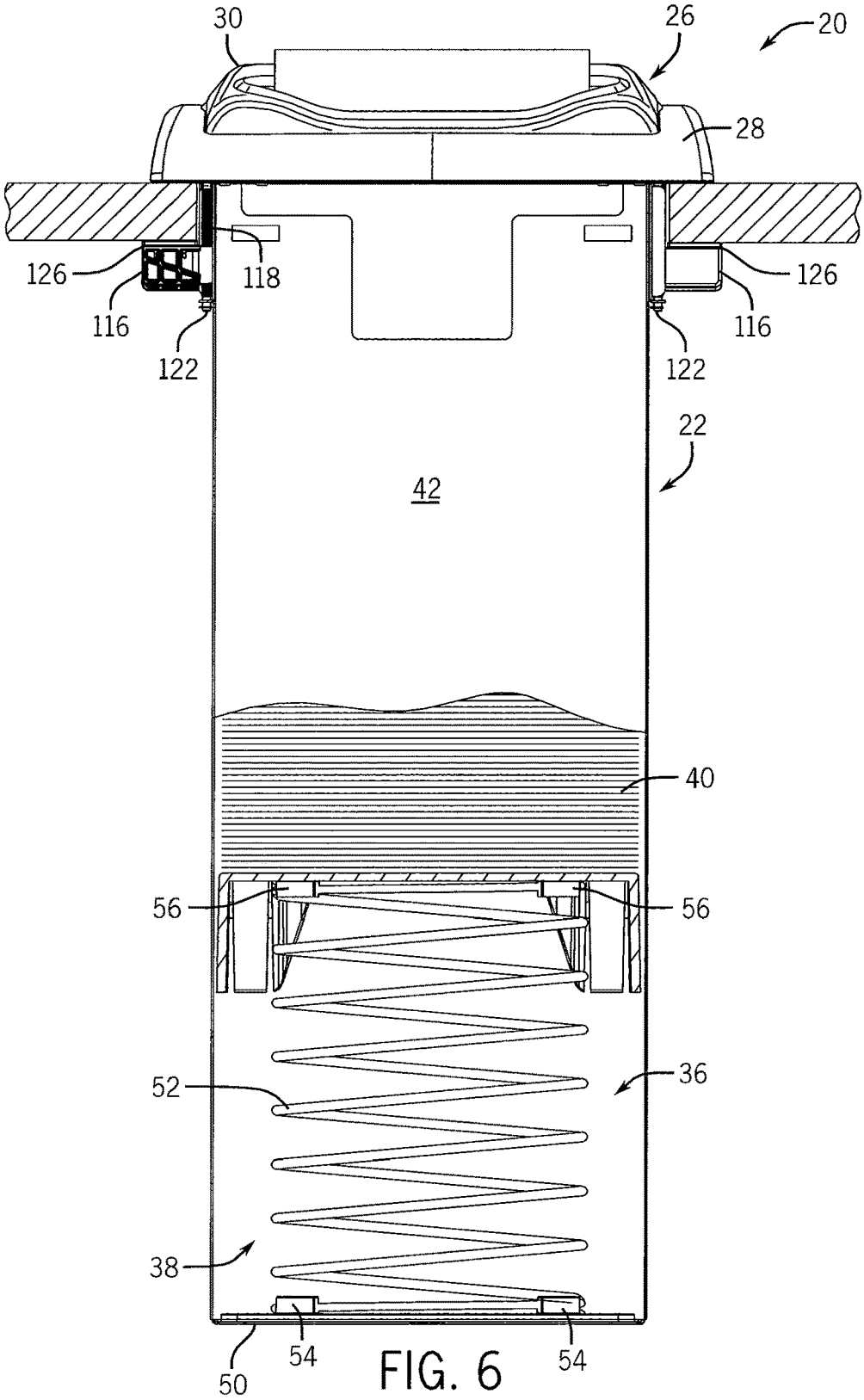
FIG. 6 is a front elevation partial cutaway view of the napkin dispenser of FIG. 1.
Figure 7:
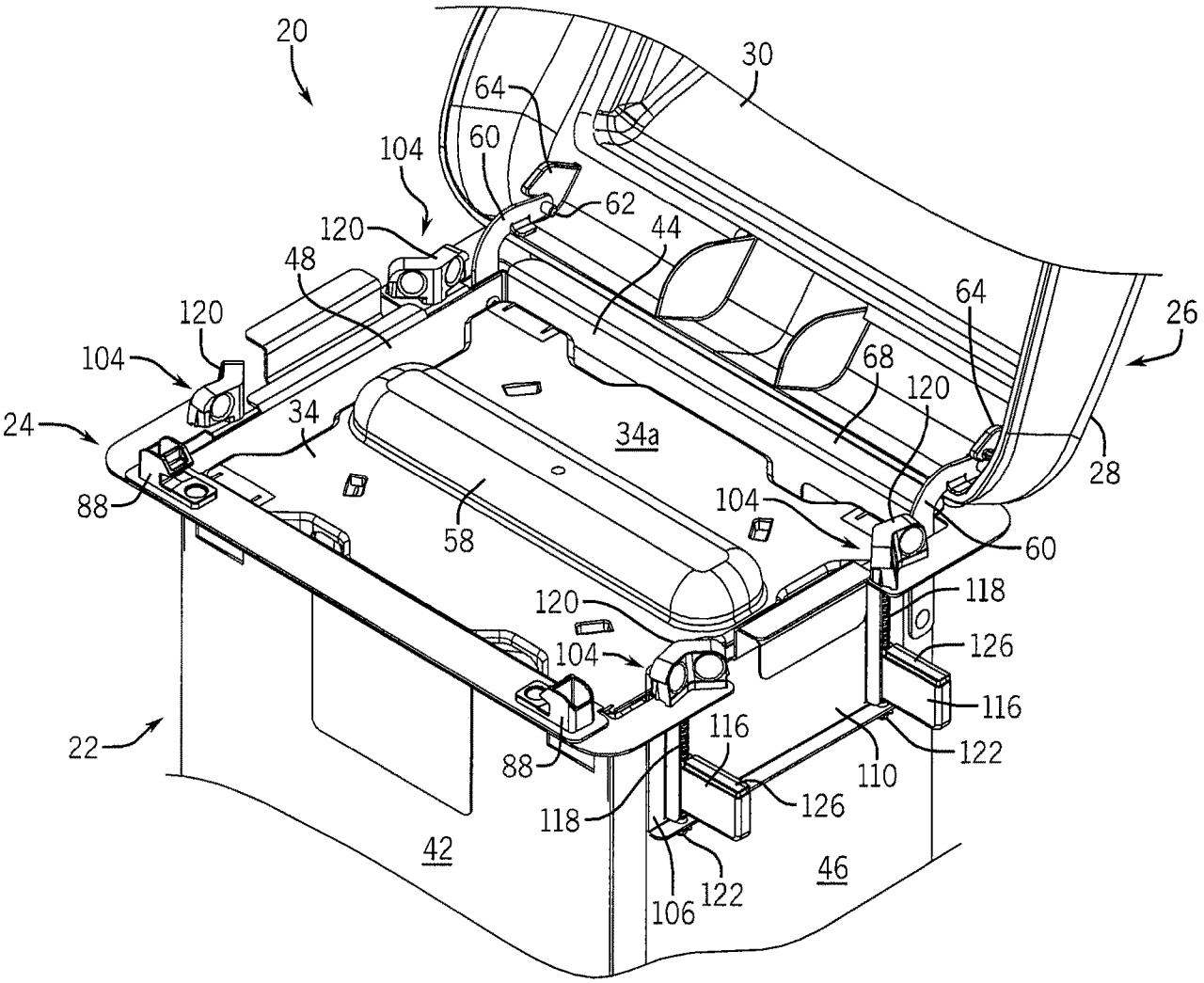
FIG. 7 is a top isometric view of the napkin dispenser of FIG. 1 with the faceplate assembly of the napkin dispenser pivoted to a raised position.

Turning now to the figures, the present invention provides a napkin dispenser 20, which is shown in FIGS. 1 and 2 as in-counter dispenser. The napkin dispenser 20 generally consists of an elongated housing 22, a collar 24, a faceplate assembly 26, which is comprised of a mounting bracket 28 and a faceplate 30 having an aperture 32, a pressure plate 34, and a biasing spring 36, shown in FIG. 3. The faceplate assembly 26 is hinged to the elongated housing 22 in a conventional manner, which allows the faceplate assembly 26 to be pivoted between a closed position (FIG. 1) and an open position for reloading (FIG. 7). It will thus be appreciated that the elongated housing 22 and the faceplate assembly 26 collectively define a storage chamber generally indicated at 38 (FIG. 6) for receiving a stack of napkins 40 to be dispensed.

The elongated housing 22 is comprised of a front panel 42, back panel 44, side panels 46, 48, and base panel 50. The set of panels are preferably formed as a single, unitary structure and are preferably made of plastic, metal or similar washable, lightweight, corrosion-resistant material. Alternately, the set of panels could be joined together in a conventional manner, such as snap-fit connections or sonic welds. In one preferred method of manufacture, the elongated housing is formed by injection molding.

Figure 4:
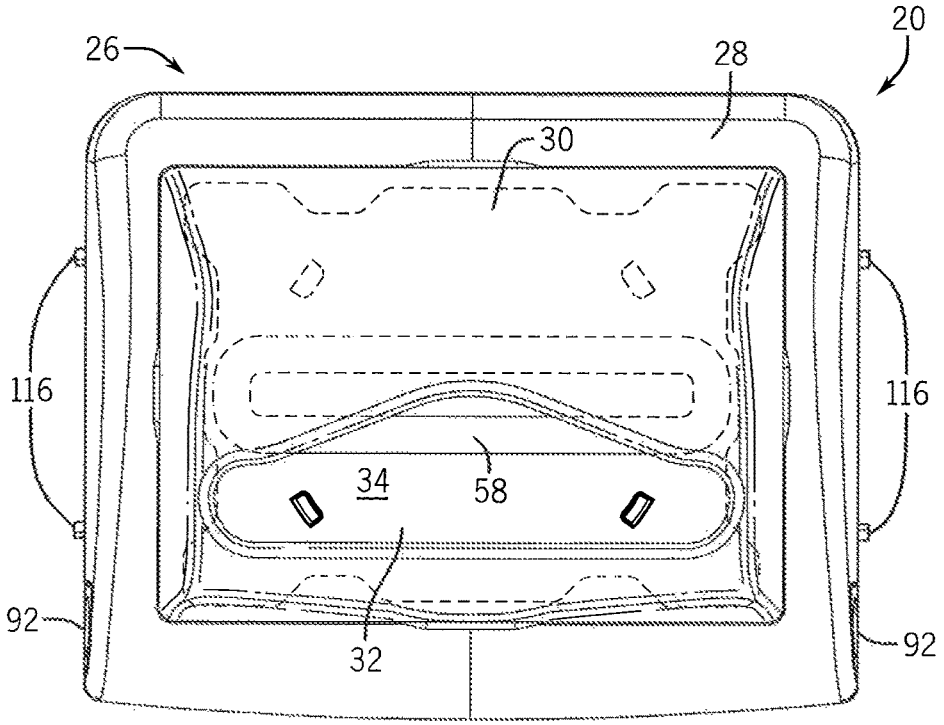
FIG. 4 is a top plan view of the napkin dispenser of FIG. 1.
Figure 5:
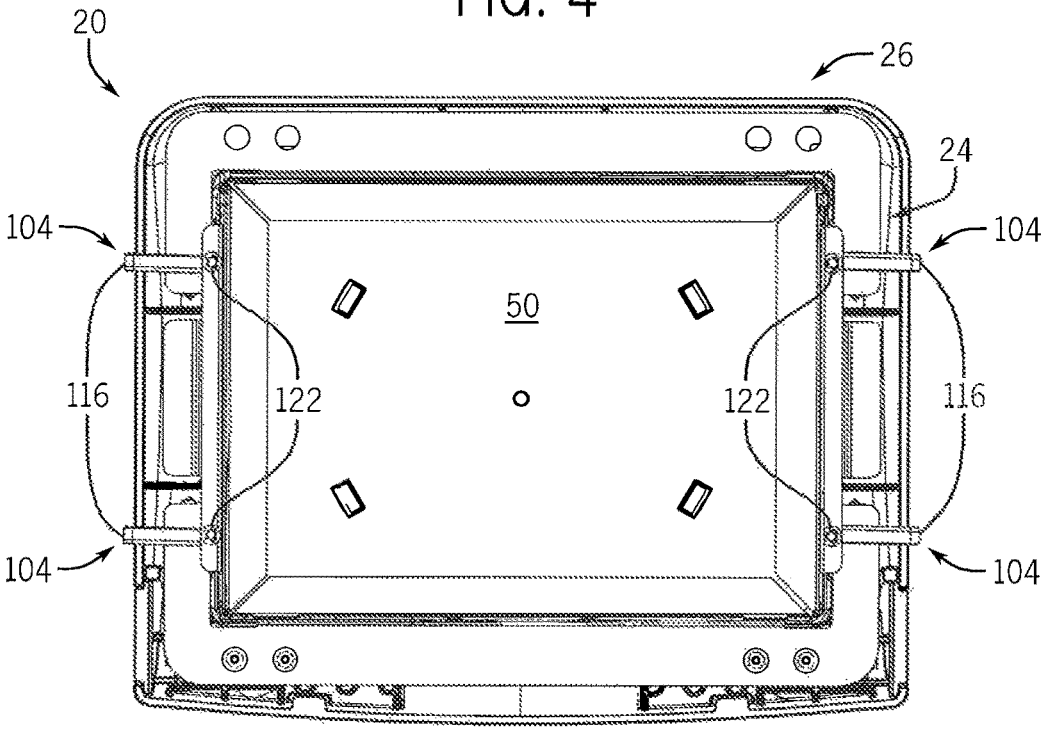
FIG. 5 is a bottom plan view of the napkin dispenser of FIG. 1.

The biasing spring 36 is interconnected between the pressure plate 34 and the base panel 50. The biasing spring 36 consists of a coiled wire 52, with one end being retained against the base panel 50 by retainers 54 and the opposite end being retained against the pressure plate 34 by retainers 56. The biasing spring 36 is a compression spring and thus is compressed as the pressure plate 34 is moved toward the base panel 50, as would happen when the napkin dispenser 20 is loaded with the stack of napkins 40, i.e., the weight and volume of the stack of napkins compresses the spring. As the stack of napkins is depleted, the biasing spring 36 pushes the pressure plate 34 toward the upper end of the napkin dispenser 20, i.e., toward the faceplate 30, to present the top of the stack of napkins 40 for removal. As best shown in FIG. 7, the pressure plate 34 preferably includes a pressure focus feature 58 formed, or otherwise attached to, the upper surface 34*a* of the pressure plate 34. The pressure focus feature 58 is designed to apply a constant pressure to the stack of napkins 40 in a particular, localized area as the pressure plate 34 moves toward the faceplate 30. The pressure focus feature 58 preferably cooperates with the faceplate 30 to maintain the napkins in normal alignment relative to the napkin dispenser 20. The location of the pressure focus feature 58 on the pressure plate 34 can be at a variety of locations but, as shown in FIG. 4, is positioned so that the pressure focus feature 58 applies a force to the napkins at about the location of the aperture 32 of the faceplate 30.

The aperture 32 enables access to the stack of napkins 40. The faceplate 30 is preferably made of injection-molded, translucent (or transparent) plastic. The aperture 32 in the illustrated embodiment is shaped for dispensing interfolded napkins but it is understood that the faceplate 30 could be designed to dispense other types of napkins.

As best shown in FIG. 7, a pair of hinges 60 preferably connects the faceplate assembly 26 to the elongated housing 22. The hinges 60 each have a generally L-shaped body with a lower end mounted to the inner surface of respective side panels 46, 48 and an upper end that extends above and outward and rearward of the elongated housing 22. Each hinge 60 has mounting pins 62 extending outwardly in a lateral direction from the upper end of the hinge 60. The mounting bracket 28 preferably has a pair of ribs 64 formed, or connected to, its underside that interfit with the mounting pins 62 to allow the faceplate assembly 26 to pivot between the open and closed positions.

The elongated housing 22 has a front lip 66 and a rear lip 68 that each extend outwardly along a plane transverse to the elongated housing. The lips 66, 68 allow the elongated housing 22 to be retained above the collar 24 when it is drop loaded into an opening 24*a* formed in the collar 24.

Figure 9:
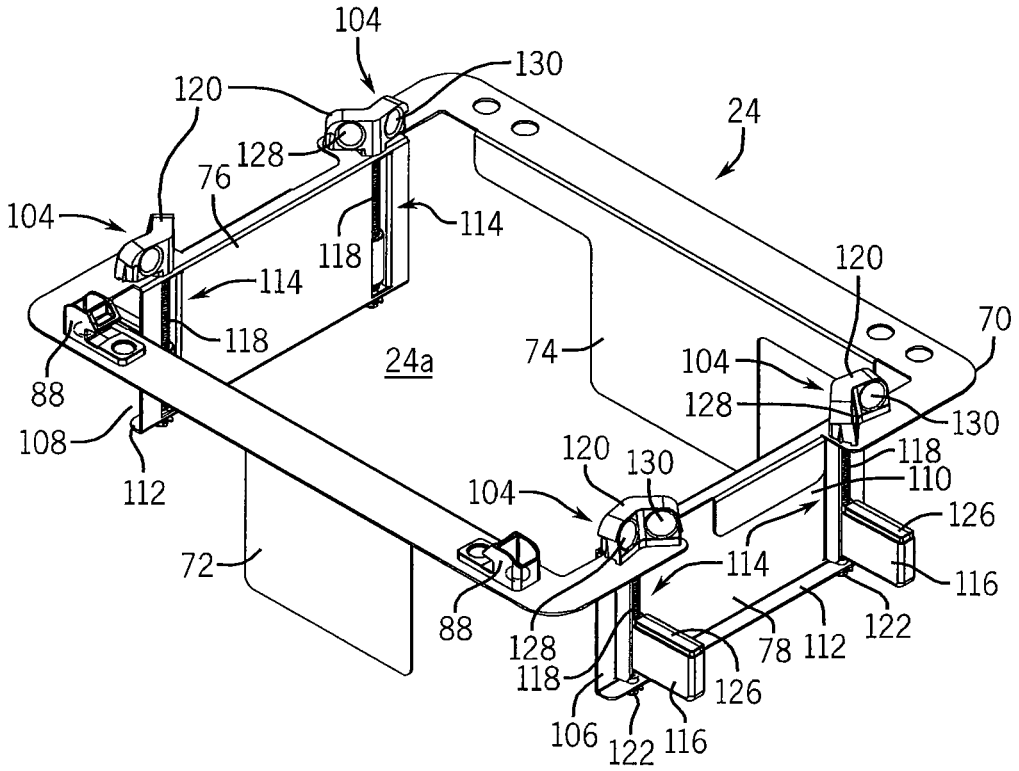
FIG. 9 is a top isometric view of a collar of the napkin dispenser of FIG. 1.

Referring to FIGS. 2 and 9, the collar 24 has an outer peripheral flange 70 that extends outwardly from the upper ends of a front partial wall 72, rear partial wall 74, and first and second partial sidewalls 76, 78. The partial walls collectively define opening 24*a* that is slightly larger than the diameter of the opening to the elongated housing 22. The outer peripheral flange 70 extends outwardly and is designed to sit on or against the top surface of a counter or wall, and more importantly, provide some leeway in the size of the opening that is needed in the counter or wall. In other words, while the opening 24*a* of the collar 24 is fit to the elongated housing 22, the outer peripheral flange 70 provides additional width so that the opening cut into the counter or the wall does not have to be precisely cut to retain the dispenser in place.

The napkin dispenser 20 preferably has a locking assembly 80 that includes a pair of locks 82, 84 for releasably locking the faceplate assembly 26 to the collar 24. Each of the locks 82, 84 preferably includes a latch 86 formed on the underside of the mounting bracket 28 and a keeper 88 that extends upward from a front portion of the outer peripheral flange 70. When the latch is engaged with the keeper, the keeper holds the front end of the mounting bracket 28 down against the collar 24.

Figure 10:
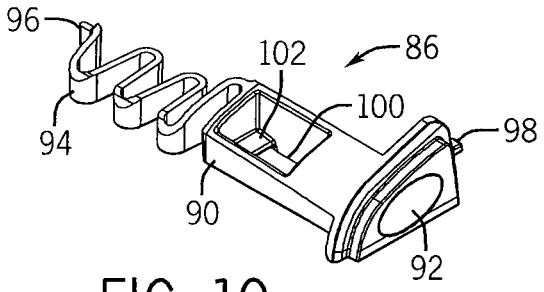
FIG. 10 is an isometric view of a latch of a locking assembly according to another aspect of the invention.

Each latch 86 includes a pusher 90 having a push pad 92 at one end and a compression spring 94 at the opposite end. The inboard end of each compression spring 94 has a tab 96 for attaching the inboard end of the compression spring 94 within the mounting bracket 28. The pusher 90 also includes a tab 98 opposite tab 96 for attaching the push pad 92 end of the pusher 90 to the mounting bracket 28. Each compression spring 94 is compressible by the application of a lateral (inward) force on the push pad 92. In this regard, each pusher 90 is movable in a lateral direction. The body of each pusher 90 has a cutout 100 that allows the keeper 88 to be received within the pusher 90. As best shown in FIG. 10, the pusher 90 includes a catch 102 that engages the keeper 88 to lock the latch 86 down. On the other hand, when the push pad 92 is pressed inwardly, the catch 102 is moved inwardly so as to move clear of the keeper 88 and thus allow the faceplate assembly 26 to be moved from the closed position to the open position. As the napkin dispenser 20 has a pair of latches 86, both latches 86 have to be released to move the faceplate assembly 26 to the open position. Each catch 102 automatically engages a respective keeper 88 when the faceplate assembly 26 is moved to the closed position as each catch 102 is deflected slightly by the keeper 88.

One of the drawbacks of conventional in-counter or in-wall dispensers is the difficulty in securing the dispenser in place. Typically, an installer must either allow the dispenser to sit unattached in the opening formed in the counter or wall, or alternately, use fasteners, such as wood screws, to fix the dispenser in place. This typically involves drilling holes into the counter and then driving screws through corresponding holes in a mounting member of the dispenser. Not only do the wood screws, or similar fasteners, mar the countertop or wall but they are also time-consuming to install. Moreover, this type of installation frequently requires the use of shims or the like to insure proper fit of the dispenser in the countertop or wall.

Accordingly, the present invention provides a napkin dispenser that can be securely attached in place without the use of tools and more efficiently than conventional in-counter/in-wall dispensers. The napkin dispenser 20 includes a set of twist-locks 104. In the illustrated embodiment, four twist-locks 104 are used to secure the collar 24 in place and thus the remaining components of the napkin dispenser 20 when the faceplate assembly 26 is locked down on the collar 24. The twist-locks 104 are arranged such that two twist-locks are positioned adjacent one side of the outer peripheral flange 70 and the other two twist-locks 104 are positioned adjacent the opposite side of the outer peripheral flange 70. In this regard, the collar 24 includes first and second carriages 106, 108 that extend from the outer peripheral flange 70 toward the base panel 50 of the elongated housing 22. Each carriage 106, 108 includes a planar member 110 that extends generally adjacent the side of the elongated housing 22 and terminates in an upturned lip 112.

Figure 8:
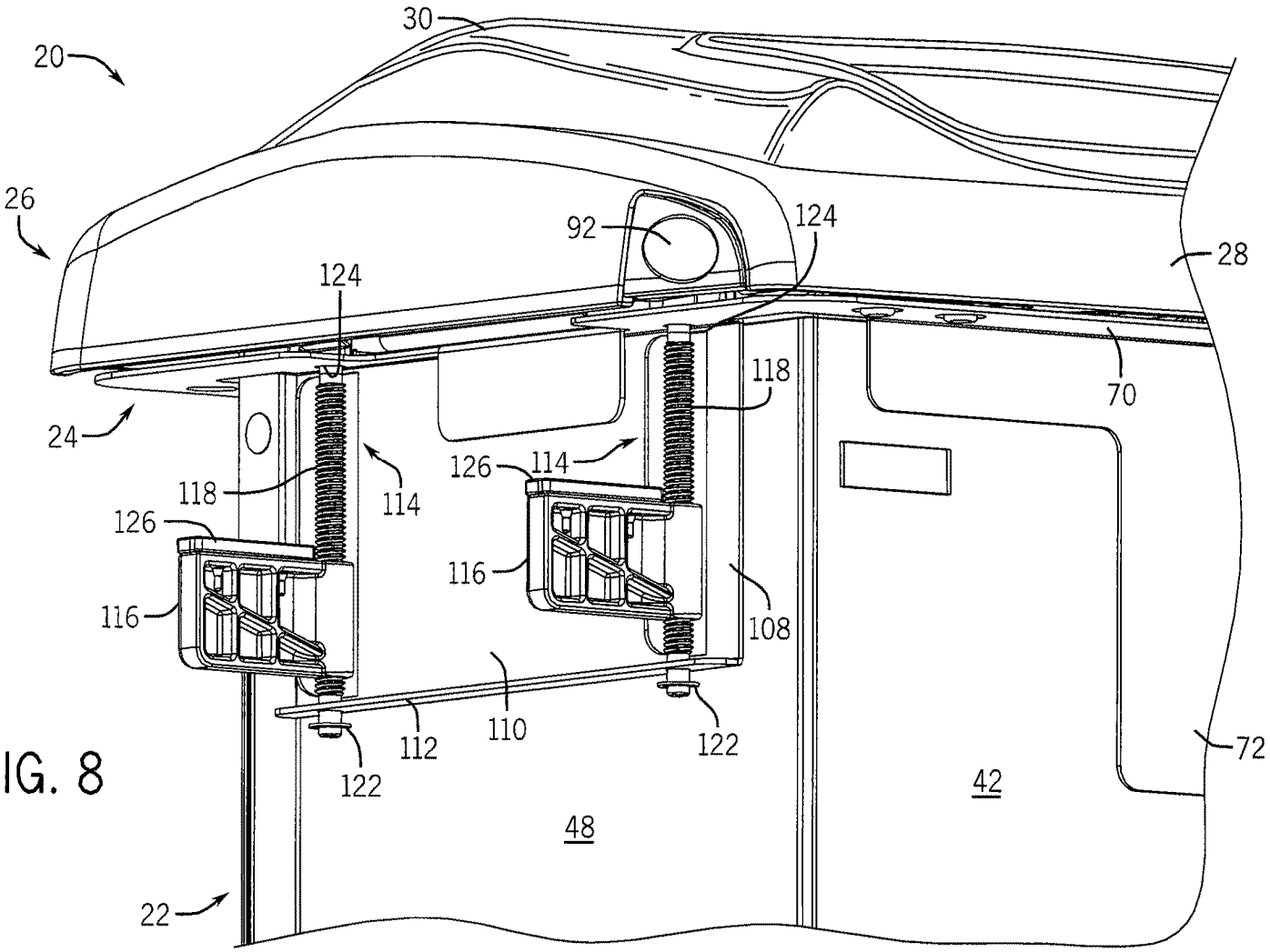
FIG. 8 is a bottom isometric view of the napkin dispenser of FIG. 1.

Each twist-lock 104 consists of an elongated screw 114 that is threadingly engaged with a flap 116. Each screw 114 includes a threaded shaft 118 that extends downwardly from a head formed by an angled nut 120 through a hole (not shown) formed in the outer peripheral flange 70 and then through hole (not shown) formed in the upturned lip 112. A cap 122 is attached to the distal end of the threaded shaft 118 that prevents the threaded shaft 118 from being pulled out of the upturned lip 112, as best shown in FIG. 8. As the angled nut 120 is rotated in a first direction (i.e., clockwise) the respective flap 116 is drawn upward along the threaded shaft 118. The angled nut 120 is rotatable in the first direction until the flap 116 reaches the upper end of threaded shaft 118 or, and as will be described more fully below, abuts against a stop, such as the underside of the countertop or the inside surface of a wall. The threaded shaft 118 passes through a respective bore 124 formed in the outer peripheral flange 70 of the collar 24. Rotation of the angled nut 120 in the opposite direction, i.e., counterclockwise, causes the flap 116 to move in the opposite direction and thus down the threaded shaft 118 to loosen the collar 24.

As noted above, the collar 24 is designed to fit within an opening formed in the countertop. The aforedescribed twist-locks 104 facilitate securing the collar 24 in place. Accordingly, after the collar 24 is seated in the countertop opening, the installer only needs to rotate each angled nut 120 to draw each flap 116 upward. The flaps 116 rotate with the angled nuts 120. Each flap rotates until it engages the underside of the countertop (or inside of wall). The installer can then make an additional quarter or half turn of the angled nut 120 to compress the corresponding flap 116 against the stopping surface. In one preferred embodiment, the top surface of each flap 116 includes a deformable member in the form of a compressible pad or rubber pad 126 that compresses as the flap 116 is tightened against the stopping surface to provide additional friction and some "play" to permit a tight fit of the dispenser to the counter or wall.

Referring briefly to FIG. 9, it can be seen that each angled nut 120, while preferably a single unitary structure, consists of first and second angled members 128, 130 preferably angled at approximately 90° relative to each other. The angular relationship of these two members is preferably set so as to conform to the desired width of the flange 70. This is because the faceplate assembly 26 will not close if the angled members 128, 130 of any of the screws 114 extend outwardly over the edge of the flange 70 and the housing 22 will not fit through the collar opening 24 if the angled members 128, 130 of the screws 114 extend inwardly over the opposite edge of the flange 70. As such, when installing the collar 24, the installer must first tighten the screws 114 until the flaps 116 are drawn into contact with the underside of the countertop for an in-counter mounting. The rubber pads 126 on the top of the flaps 116 allow the installer additional slack to further rotate the thumb screws 114 if necessary to position the angled members 128, 130 within the confines of the flange 70 so that the elongated housing can be placed through the collar opening 24*a* and the faceplate assembly 26 closed. It will thus be appreciated that the screws 114 perform two separate functions. They are used to mount and hold the collar in place but also secure the flaps in place once the screws are tightened.

Figure 11:
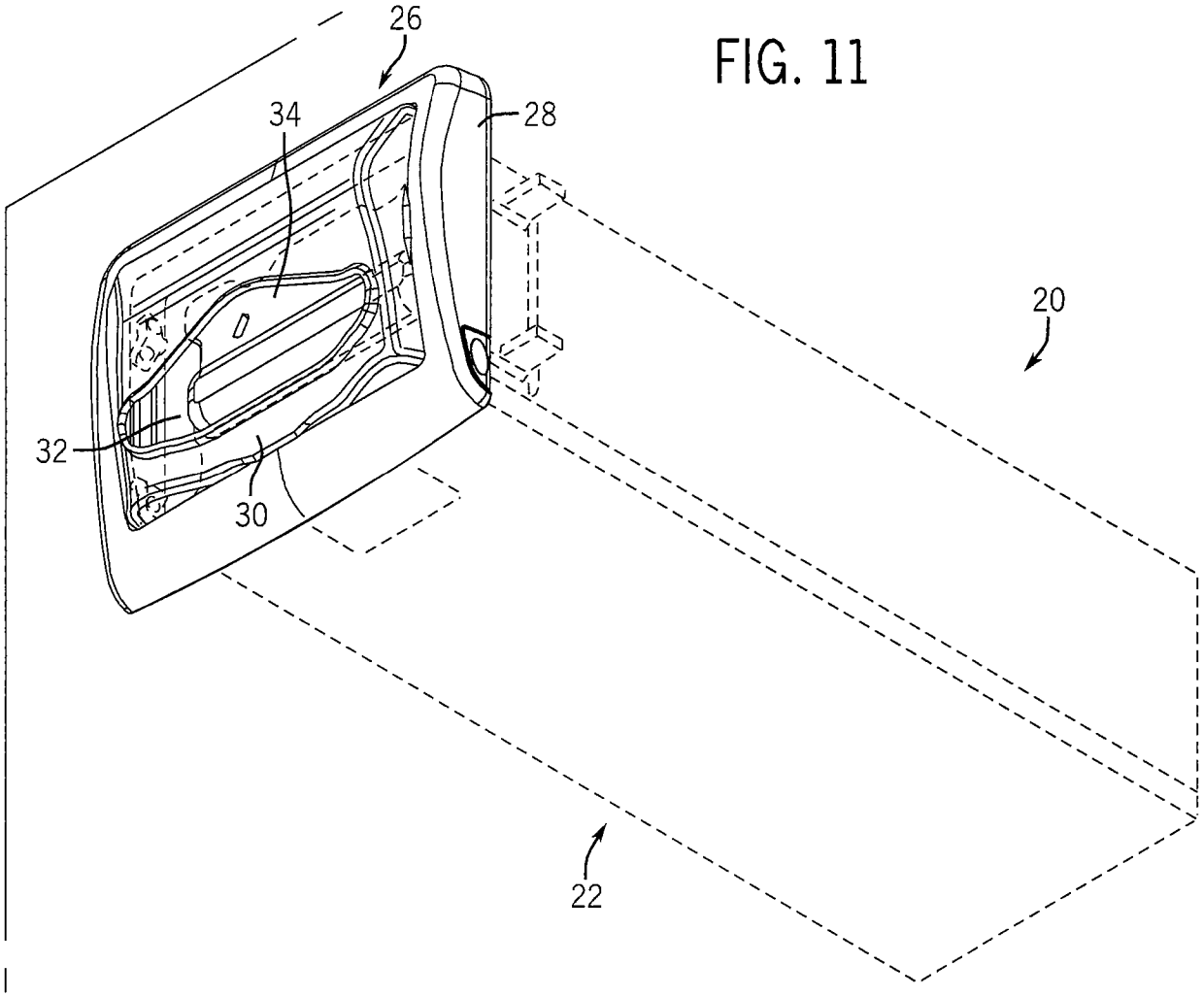
FIG. 11 is an isometric view of the napkin dispenser of the present invention shown in an in-wall position.

As shown in FIGS. 1-10, in one embodiment, the napkin dispenser 20 is mounted in a counter. However, the napkin dispenser 20 can also be mounted horizontally such as in a counter or in a wall, as shown in FIG. 11.

While the present invention has been described with respect to a napkin dispenser, it is understood that the principles and features of the invention can be incorporated and are applicable with other types of dispensers, such as cup dispensers, lid dispensers, tissue or paper dispensers, trash/refuse chutes, scrap collectors, and the like.

Various alternatives and embodiments are contemplated as being within the scope of the following claims particularly pointing out and distinctly claiming the subject matter regarded as the invention.

The invention claimed is:

1. A dispensing system for use in a recessed position, comprising:

a collar adapted to fit in an opening formed in a wall or counter;

a set of retainers for releasably securing the collar to the wall or counter, each retainer including a clamping member operative to clamp the collar to the wall or counter;

a product dispenser having an elongated housing adapted to fit within the collar opening and a faceplate assembly releasably attached to the elongated housing and having an aperture that facilitates removal of product from the elongated housing; and each clamping member including a screw having a shaft with a first end and a second end, a head at the first end, and a flap at the second end, wherein the flap is configured to travel along the shaft toward the first end upon rotation of the head.

2. The dispensing system of claim 1 wherein the flap includes a surface engaging end and a compressible pad attached to the surface engaging end.

3. The dispensing system of claim 1 wherein the faceplate assembly includes a mounting bracket hinged to the elongated housing and a faceplate secured to the mounting bracket.

4. The dispensing system of claim 3 further comprising a locking arrangement for locking the faceplate assembly in a closed position, the locking arrangement including a keeper extending from the collar and a latch carried by the faceplate assembly and operative to releasably engage the keeper when the faceplate assembly is pivoted to the closed position.

5. The dispensing system of claim 4 wherein the latch includes a spring and a catch, and wherein compression of the spring clears the catch from engagement with the keeper to enable movement of the faceplate assembly from the closed position to an open position.

6. The dispensing system of claim 1 wherein the product dispenser is adapted to dispense napkins.

7. The dispensing system of claim 1 wherein each clamping member includes a deformable member disposed between each retainer and the wall or counter.

8. A napkin dispenser comprising:

an elongated housing adapted to hold a stack of napkins;

a faceplate pivotally connected to the elongated housing, the faceplate having an aperture for withdrawing an outermost napkin from the stack of napkins, and pivotal between an open position and a closed position;

a collar that fits within an opening of a supporting surface, and adapted to receive the elongated housing and support the elongated housing in a recessed position behind the supporting surface; and a set of clamps that releasably secure the collar to the supporting surface, each clamp including a thumb screw having a shaft with a first end and a second end, a thumb-engaging portion at the first end, and an outwardly extending flap at the second end, wherein the flap is configured to travel along the shaft toward the first end upon rotation of the thumb-engaging portion to engage an underside of the supporting surface.

9. The napkin dispenser of claim 8 further comprising a locking arrangement for locking the faceplate in the closed position, the locking arrangement including a keeper extending from the collar and a latch carried by the faceplate and operative to releasably engage the keeper when the faceplate is pivoted to the closed position.

* * * * *